US006769765B2

(12) United States Patent
Kneezel et al.

(10) Patent No.: US 6,769,765 B2
(45) Date of Patent: Aug. 3, 2004

(54) FILTER WITH INTEGRAL HEATING ELEMENT

(75) Inventors: Gary A. Kneezel, Webster, NY (US); Peter J. John, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/200,437

(22) Filed: Jul. 22, 2002

(65) Prior Publication Data

US 2004/0012662 A1 Jan. 22, 2004

(51) Int. Cl.[7] ..... B41J 2/20
(52) U.S. Cl. ..... 347/93; 210/185
(58) Field of Search ..... 347/62, 65, 93, 347/206; 210/184, 185

(56) References Cited

U.S. PATENT DOCUMENTS

| | | | | |
|---|---|---|---|---|
| 586,593 A | * | 7/1897 | Chamberlain | 210/185 |
| 2,727,632 A | * | 12/1955 | Mack | 210/185 |
| 3,608,610 A | * | 9/1971 | Greatorex | 210/185 |
| 4,561,789 A | * | 12/1985 | Saito | 346/140.1 |
| 4,638,337 A | | 1/1987 | Torpey et al. | 347/65 |
| 4,914,562 A | * | 4/1990 | Abe et al. | 347/63 |
| 5,341,162 A | | 8/1994 | Hermanson et al. | 347/92 |
| 5,742,314 A | | 4/1998 | Hayes | 347/93 |
| 6,000,787 A | * | 12/1999 | Weber et al. | 347/65 |
| 6,127,198 A | | 10/2000 | Coleman et al. | 438/21 |
| 6,139,674 A | | 10/2000 | Markham et al. | 156/252 |
| 6,199,980 B1 | | 3/2001 | Fisher et al. | 347/93 |
| 6,236,414 B1 | * | 5/2001 | Suzuki et al. | 346/140.1 |
| 6,398,348 B1 | * | 6/2002 | Haluzak et al. | 347/63 |
| 6,402,283 B2 | * | 6/2002 | Schulte | 347/15 |

FOREIGN PATENT DOCUMENTS

EP 924 077 A2 * 6/1999 ..... B41J/2/14

* cited by examiner

*Primary Examiner*—Stephen D. Meier
*Assistant Examiner*—Blaise Mouttet
(74) *Attorney, Agent, or Firm*—Fay, Sharpe, Fagan, Minnich & McKee, LLP

(57) ABSTRACT

An apparatus (22, 122) for filtering a substance (13) includes an electrically insulating substrate (30, 130) that separates a source volume (12) containing the substance (13) from a target volume (18). The substrate (30, 130) has a first side in fluid communication with the source volume (12) and a second side in fluid communication with the target volume (18). The substrate (30, 130) further includes a plurality of openings (42, 142) connecting the first side with the second side. The openings (42, 142) are sized to provide filtering fluid communication between the source volume (12) and the target volume (18) for at least one phase of the substance. A heater film (32) is deposited over selected portions of the substrate (30, 130). The heater film (32) contacts the substrate (30, 130) to heat at least a portion of the openings (42, 142).

13 Claims, 8 Drawing Sheets

FILTER WITH INTEGRAL HEATING ELEMENT

BACKGROUND OF THE INVENTION

The present invention relates to the fluid processing arts. It finds particular application in conjunction with the heating and filtering of ink in ink jet printers, and will be described with particular reference thereto. However, it is to be appreciated that the present invention will also find application in the heating and filtering of fluids, gases, liquids, melting solids, evaporating solids, plasmas, particulate matter, or various combinations thereof for ink jet, electrophotographic, and other types of printing, as well as for a wide range of other fluid processing applications in the printing, medical, automotive and other arts.

An ink jet printer includes one or more printheads which apply ink droplets to paper to create printed text, graphics, images, and the like. Each printhead typically includes an ink reservoir, an ink buffer, or a fluid connection to a remote ink supply, and a tube or nozzle from which ink is ejected responsive to an applied energy pulse. In thermal ink jet printing a thermal pulse is applied to partially vaporize ink and eject one or more ink droplets. In acoustic ink jet printing, an acoustic energy pulse is applied using a piezoelectric transducer. Other approaches for effectuating the ink ejection, such as electrostatic mechanisms and microelectromechanical systems (MEMS), are also known.

Accurate control of the ink temperature is important for well controlled and reproducible ink jet printing. The ink temperature affects viscosity and other fluid properties which in turn affect the ink flow into the nozzle and the size or mass of the produced ink droplets. At cooler temperatures, ink viscosity increases and ink flow in the narrow passages of the printhead is impeded. Furthermore, when using inks which are solid at room temperature, a heating mechanism is required to liquefy or melt the ink. In the past, foil heaters have been employed to heat the ink.

Other problems can arise in ink jet printers due to particulate contaminants in the flowing ink. Such particulates can clog the nozzle or other narrow ink paths in the printhead. Another problematic ink contaminant is air dissolved into the ink. The dissolved air can accumulate into air bubbles in the printhead, producing flow blockages and printhead failure. Problems with air bubbles are particularly prevalent in isothermal chip designs. In the past, contaminant problems have been addressed by employing a porous filter arranged after the foil heater in the ink path. U.S. Pat. No. 6,139,674 issued to Markham et al. describe one such porous filter, in which the pores are formed by laser ablation in cooperation with a masking system.

The existing solutions to the heating and contamination problems have some disadvantages. The foil heater and the porous filter occupy valuable space, which can be problematic. Space in printheads is usually at a premium because it is desirable to include a large number of nozzles or ink ejectors for rapid parallel deposition of ink droplets. In addition, because the separate heater and filter elements occupy a large space, substantial energy is dissipated in the heater in order to transfer sufficient heat to the region near the filter pores. Furthermore, in carriage-type printers where the printhead moves back-and-forth across the page during printing, reduction of printhead size is advantageous. The pores of the porous filters are also susceptible to clogging by the ink during the filtering.

The present invention contemplates a new and improved method and apparatus which overcomes the above-referenced problems and others.

SUMMARY OF THE INVENTION

In accordance with one aspect of the present invention, an apparatus for filtering a substance is disclosed. An electrically insulating substrate separates a source volume containing the substance from a target volume. The substrate has a first side in fluid communication with the source volume and a second side in fluid communication with the target volume. The substrate further includes a plurality of openings connecting the first side with the second side. The openings are sized to provide filtering fluid communication between the source volume and the target volume for at least one phase of the substance. A heater film is disposed over and supported by selected portions of the substrate. The heater film contacts the substrate to heat at least a portion of the openings.

In accordance with another aspect of the present invention, an ink processing element is disclosed for use in a printhead. The ink processing element includes a substantially planar insulating substrate arranged in an ink path. The substrate has one or more porous areas that filter ink moving through the ink path. A heater film is deposited onto the insulating substrate and heats the porous areas of the insulating substrate responsive to an electrical input.

In accordance with yet another aspect of the present invention, a printhead is disclosed, including an ink reservoir containing ink, an ink jet die in fluid communication with the ink reservoir, and an ink processing element arranged in the fluid communication path between the ink reservoir and the ink jet die. The ink processing element includes a substrate having a plurality of pores formed therethrough. The pores are sized to provide a selected filtering of ink passing between the ink reservoir and the ink jet die via the pores. The ink processing element further includes a heater film integrated with the substrate to form a planar ink processing element. The heater film is deposited on the substrate and patterned to define a selected heater shape.

In accordance with still yet another aspect of the present invention, a method is provided for fabricating a substance-processing element. Openings are defined through an insulating substrate. The openings are sized to provide a selected filtering of the substance, and are arranged to define porous filtering areas. A resistive heater film is deposited over selected areas of the substrate to define a foil heater that heats at least the porous filtering areas responsive to an electrical input.

Numerous advantages and benefits of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

FIG. 3 shows an enlarged portion of the ink processing element of FIG. 2 including two heater legs and a plurality of pores arranged in between.

DETAILED DESCRIPTION OF THE PREFERRED EMBODIMENTS

Figure 1:
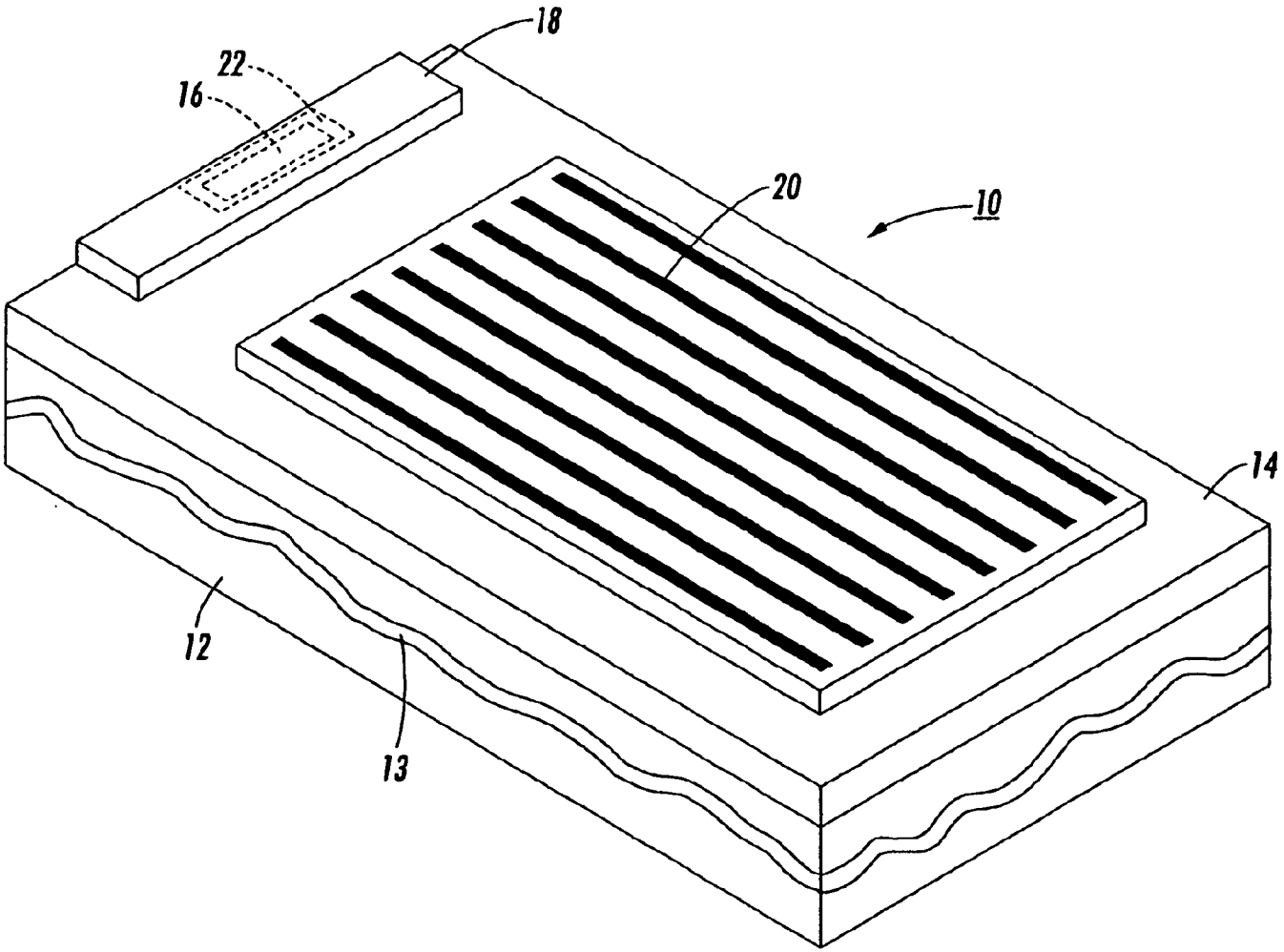
FIG. 1 schematically illustrates an exemplary roof shooting thermal ink jet printhead including an ink processing element (shown in phantom) that suitably practices an embodiment of the invention.

With reference to FIG. 1, an exemplary roof shooting thermal ink jet printhead 10 includes an ink reservoir 12 containing an ink supply 13. A printhead substrate 14 is arranged over the ink reservoir 12 and seals the reservoir 12 except for an opening 16 (shown in phantom) through which a thermal ink jet die 18 draws ink in to replenish the ink that has been ejected in response to electronic control signals received from a printed wiring board 20. Ink passing from the reservoir 12 to the die 18 via the opening 16 is processed by an ink processing element 22 (shown in phantom, also called herein a substance processing element), which incorporates both filtering and heating capability into a single substantially planar element.

Although a roof shooting thermal ink jet printhead 10 is exemplarily shown in FIG. 1, it is to be appreciated that the invention is not limited thereto, but will also find application in other types of ink jet printheads such as side-shooting printheads, acoustic ink jet printheads, printheads incorporating microelectromechanical system (MEMS) based ejectors, and the like, as well as in other types of printers and other applications in which a fluid processing element combining heating and filtering capability is advantageously employed, such as automotive and medical fluid processing applications. The invention will also find application in electrophotographic printing for processing the toner, developer or other substances used in transferring an electrostatic image formed by light or other photon radiation on an electrically insulative medium to a paper or other permanent medium.

Furthermore, although the invention is described with exemplary reference to processing printing ink, those skilled in the art will recognize that the invention is also applicable for processing other substances such as fluids, gases, liquids, melting solids, evaporating solids, plasmas, particulate matter, biological material, pharmaceuticals, and the like.

Figure 2:
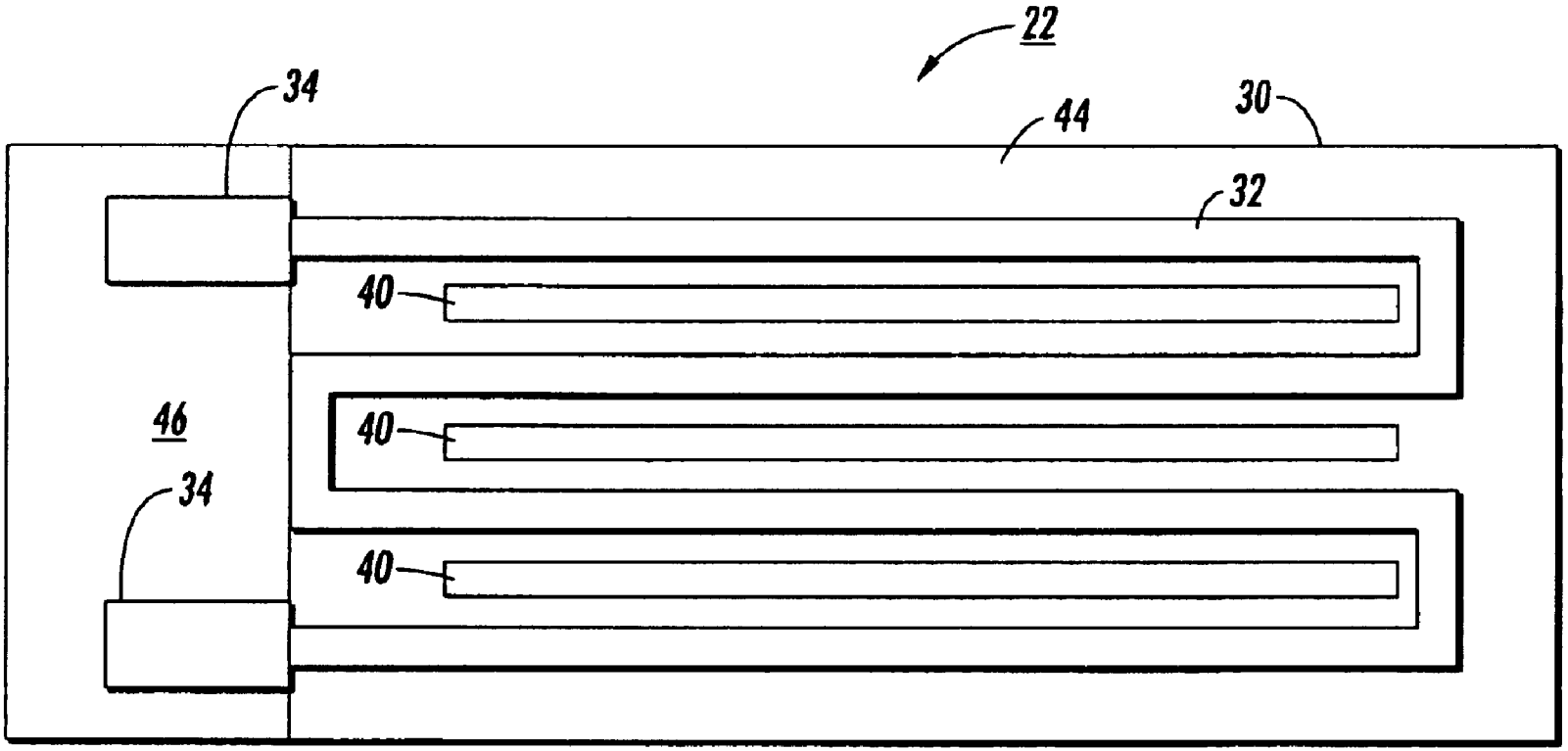
FIG. 2 shows the ink processing element of FIG. 1 which integrates the ink filtering and ink heating operations into a single element.
Figure 3:
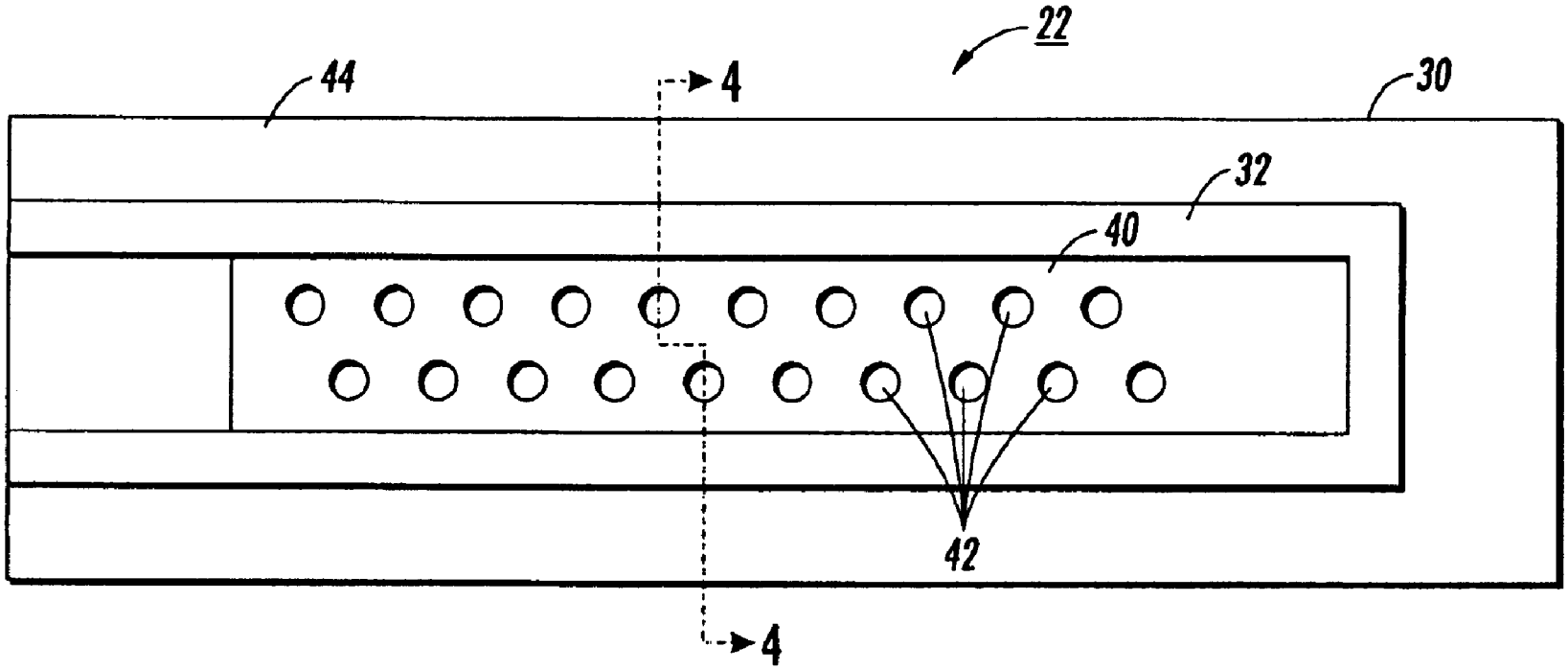
Figure 4:
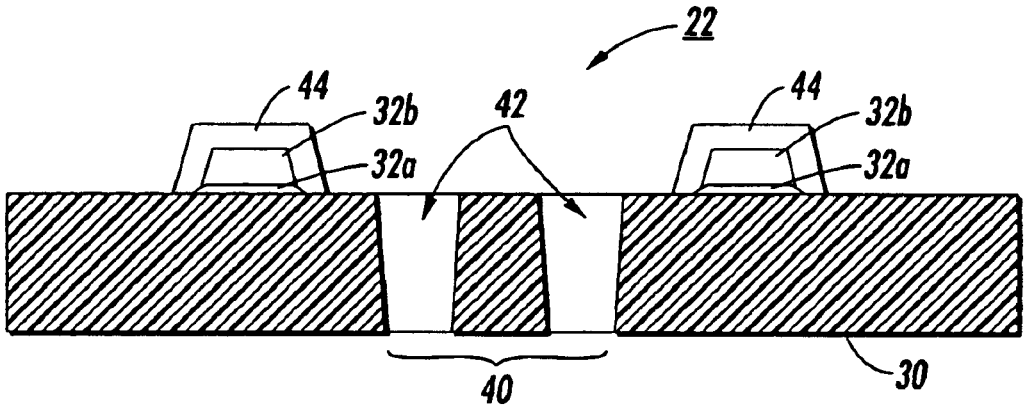
FIG. 4 shows a schematic cross-sectional view of the enlarged portion of FIG. 3 taken along the section 4—4 indicated in FIG. 3.

With reference to FIGS. 2, 3, and 4, the substance processing element 22 includes an electrically insulating substrate 30 which can be a film or sheet of a polymer material such as a Upilex® (available from Ube Industries, Ltd.) or Kapton® (available from DuPont Corporation). In a suitable embodiment, the substrate 30 is about 25 microns thick. A heater film 32 is deposited onto the substrate 30 and patterned into a shape selected to promote heat generation and distribution across at least a selected portion of the substrate. As seen in FIG. 2, the heater is patterned to form a serpentine shape. The heater film 32 is suitably deposited as a two-layer film including a thin vacuum sputtered metal seed layer 32*a* which is suitably patterned and on which is electroplated a thicker resistive metallic film 32*b*, such as an alloy of nickel and chromium. The electroplated layer 32*b* is the principal electrically conductive layer of the heater film 32. Those skilled in the art can select other materials and appropriate heater film materials, shapes, and dimensions to provide a selected electrical resistance distribution corresponding to a selected thermal heating distribution. The heater film 32 includes two contact pads 34. The contact pads are optionally coated with tin (not shown) or otherwise treated to facilitate soldering or other suitable electrical connection.

With continuing reference to FIGS. 2–4, the electrically insulating substrate 30 includes one or more porous areas 40 arranged between the legs of the serpentine-patterned heater film 32. The porous areas 40 include a plurality of openings or pores 42 passing through the substrate 30 to provide filtered fluid communication through the porous areas 40 of the substrate 30. In a suitable embodiment for ink filtering, the openings 42 are in the range 5 microns to 15 microns in diameter, or larger. The size of the filter pores 42 is selected to be as large as possible to maximize the ink flow rate through the porous areas 40, but is made small enough so that it will substantially screen out particles which could otherwise plug up internal passages of the thermal ink jet die 18 (FIG. 1).

In a suitable embodiment, the openings 42 are formed by laser ablation using a mask system to define individual pore cross-sections. Those skilled in the art will recognize that laser-ablated pores will typically include a taper angle resulting from the laser ablation process, which becomes more pronounced for thicker substrates. Although a circular pore cross-section is shown in FIG. 3, it is also contemplated to employ other selected cross-sections, such as square or rectangular cross-sections, to increase the filtering selectivity for particles of a selected shape.

An insulating covering film or sheet 44 is applied over at least the heater film 32 to provide electrical isolation and sealing of the heater film 32 from external contaminants such as the ink. In a suitable fabrication process, the insulating cover film or sheet 44 is also made of a polymer such as Upilex® (available from Ube Industries, Ltd.) or Kapton® (available from DuPont Corporation), and is patterned to expose and permit fluid transport through the porous areas 40. The insulating cover 44 is also preferably patterned in a region 46 to provide electrical accessibility to the contact pads 34. In another suitable fabrication process, the insulating covering film 44 is electrolytically deposited and then patterned.

Optionally, the patterning of the insulating cover 44 is omitted, and the openings 42 are produced by laser ablation through both the substrate 30 and the cover 44. However, omission of the patterning increases the total thickness penetrated by the laser ablation. As a result, the tapering of the openings 42 due to the laser ablation process becomes more pronounced due to the greater total thickness being penetrated. The covering film or sheet 44 is optionally omitted if the substance processing element 22 processes an electrically insulating fluid which does not react with or otherwise damage the heater film 32.

Figure 5:
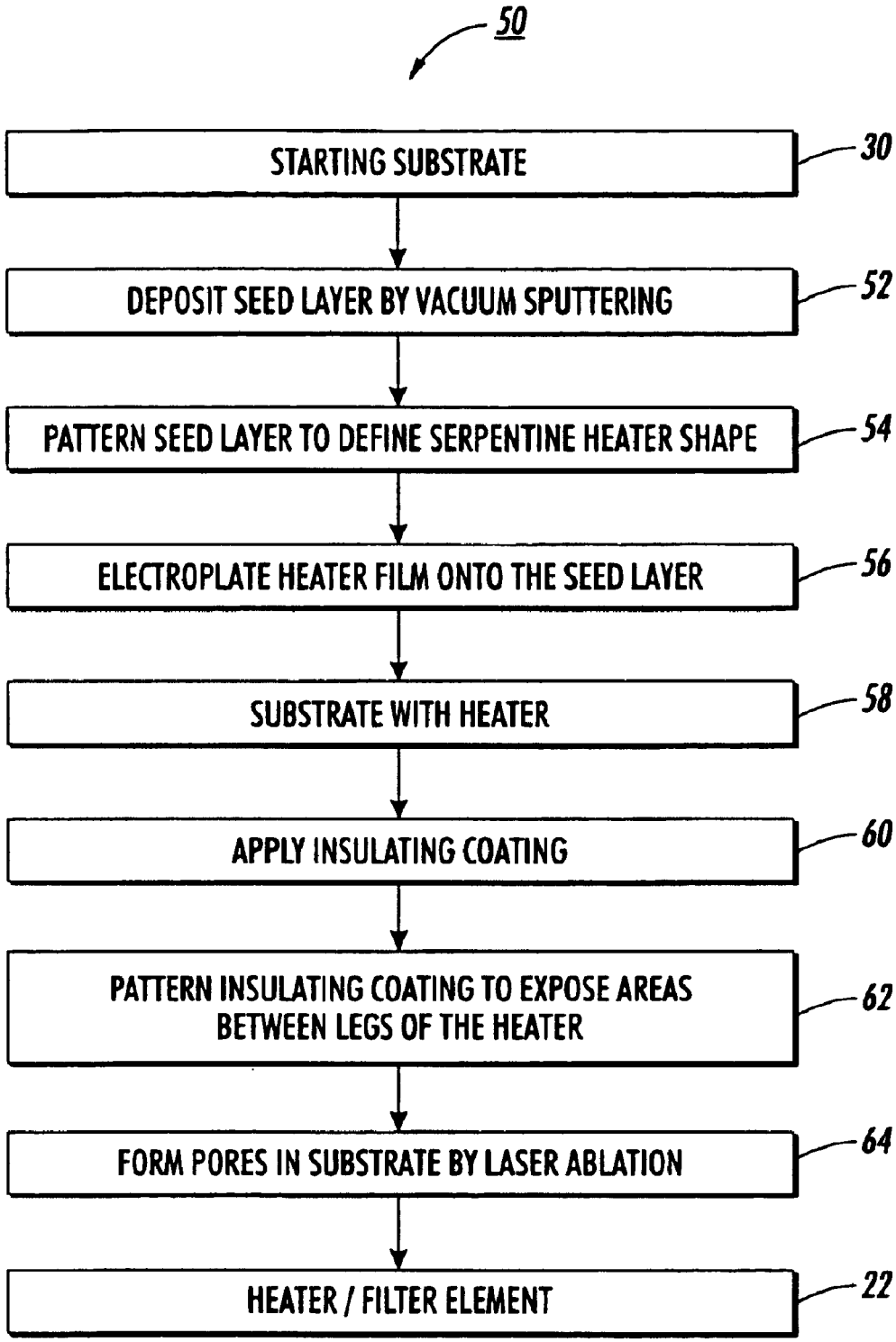
FIG. 5 flowcharts a method for fabricating the ink processing element of FIGS. 2, 3, and 4.

With continuing reference to FIGS. 2–4 and with further reference to FIG. 5, a suitable method 50 for fabricating the substance processing element 22 is described. Beginning with the starting substrate 30 such as a polymer film of Upilex® or Kapton®, the seed layer 32*a* is deposited in a step 52 by a deposition techniques such as vacuum sputtering, thermal evaporation, electron beam evaporation, or the like. The seed layer 32*a* is lithographically patterned in a step 54 to define the serpentine or other selected heat-distributing shape of the heater film 32. Various photolithography techniques known to the art, for example, are suitable for performing the patterning 54. The electrically active material 32*b* is then applied by electroplating in a step 56 to produce a substrate/heater element 58. The insulating coating 44 is then applied in a step 60. The coating 44 can be applied 60 by heat bonding, or can be applied as an electrolytically- or otherwise-deposited film, a varnish coating, or the like. The insulating film 44 is patterned in a step 62 to expose the porous areas 40. The pores 42 are formed in the porous areas 40 in a step 64, preferably by a laser ablation technique employing a mask to define the laser ablated areas that correspond to the pores, to complete fabrication of the substance processing element 22 having an integrated heater/filter design.

With continuing reference to FIGS. 2–4 and with returning reference to FIG. 1, the heater/filter element 22 receives electrical power through the contact pads 34 to drive the heating, for example via connections (not shown) with the printed circuit board 20. The heating is optionally run in an open loop fashion. Alternatively, a thermal sensor (not shown) can be included in thermal contact with the ink reservoir 12, or integrated within the ink jet die 18, to facilitate a feedback control of power input to the heater portion of the substance processing element 22.

A particular advantage of the substance processing element 22 is the capability of thermally regenerating the filtering aspect of the device 22. In spite of the integral heating, clogging of the pores 42 may still occur to some extent depending upon the type of fluid being filtered, the heating temperature, pore dimensions, and the like. By applying a current pulse via the contact pads 34 to the heater film 32, a short, substantial thermal pulse can be applied to heat and dissolve, melt, evaporate, reduce viscosity, or otherwise cause dissipation of deposits of ink or other contaminants that partially or completely block the pores 42. Since the heater film 32 is in direct thermal contact with the substrate 30 and in very close proximity to the pores 42, the heat is effectively coupled to the pores 42 and so thermal damage to nearby printhead components such as the ink jet die 18 is avoided during the thermal regenerating. In addition, thermal efficiency is improved so that undesirable amounts of heating are avoided.

Figure 6:
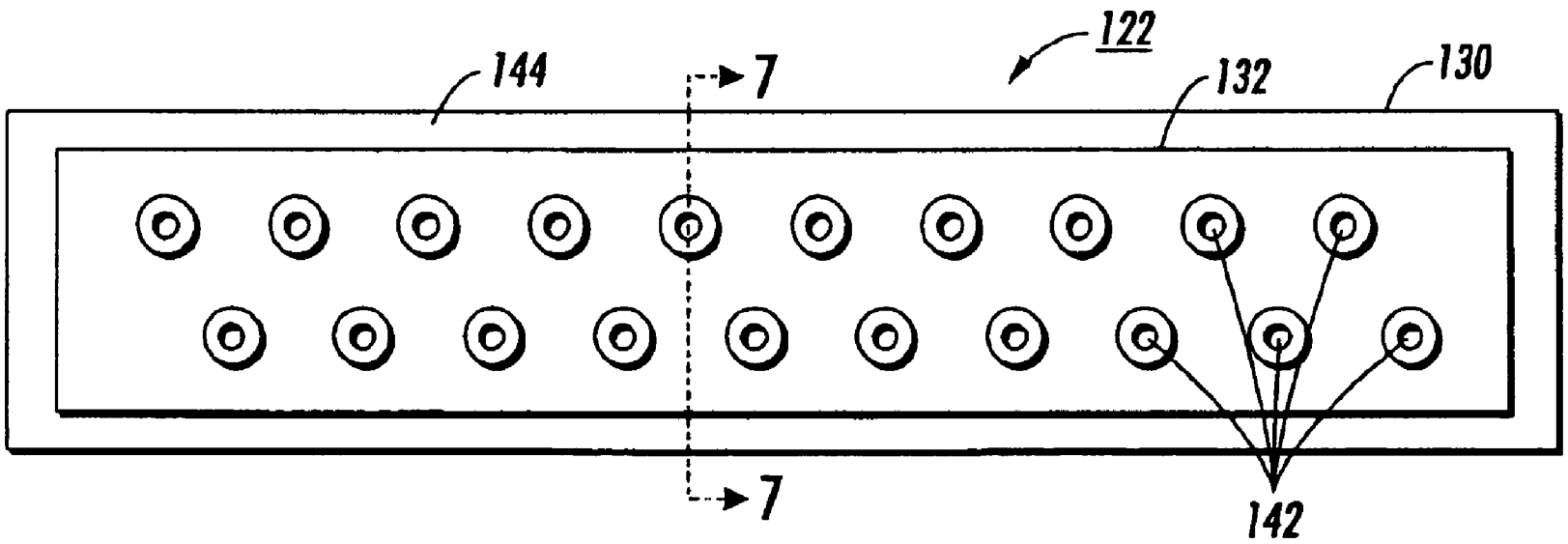
FIG. 6 shows a combined filter/heater formed in accordance with a second embodiment of the invention.
Figure 7:
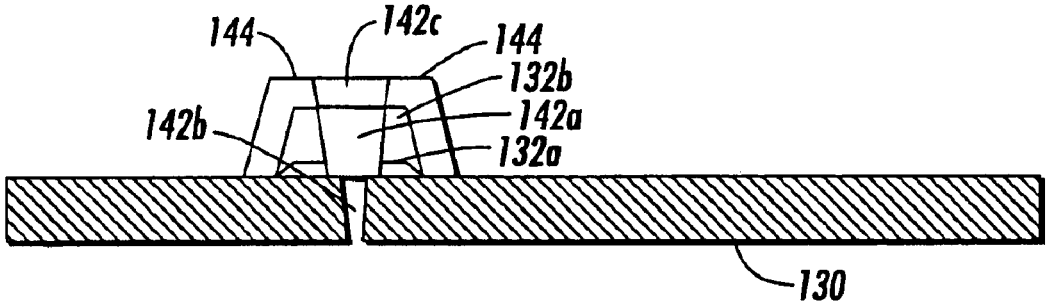
FIG. 7 shows a schematic cross-sectional view of the enlarged portion of FIG. 6 taken along the section 7—7 indicated in FIG. 6.

With reference to FIGS. 6 and 7, an alternate embodiment of the substance processing element 122 is described. An electrically insulating substrate 130, for example made of a polymer sheet of Upilex® or Kapton®, has arranged thereon a heater film 132 including a first seed metal layer 132*a* deposited onto the substrate 130 and patterned into a serpentine- or otherwise-shaped film, and an electrically resistive metal layer 132*b* which is electroplated onto the seed layer 132*a*. The electrically active layer 132*b* is suitably formed of an alloy of nickel and chromium. The patterning of the seed layer 132*a*, in addition to defining the serpentine or other shape, additionally creates openings 142*a* which together with openings 142*b* formed into the substrate inside the openings 142*a* (e.g., by laser ablation) define pores 142. A covering polymer film or sheet 144 is applied arranged on top of the insulating substrate 130 and patterned to provide pore openings 142*c* in the covering polymer 144. The cover 144 is optionally omitted if the processed fluid is insulating and does not damage the material of the heater film 132.

Thus, as best seen in FIG. 6 which shows a single leg of the serpentine heater film 132, in the substance processing element 122 the pores 142 are arranged within and surrounded by the heater film 132. In this embodiment the heater film 132 overlays the porous region to bring the filter pores 142 into close proximity with the heating. This arrangement is particularly effective at coupling the heating with the filtering to reduce clogging of the pores 142 by viscous ink or other process fluid.

Figure 8:
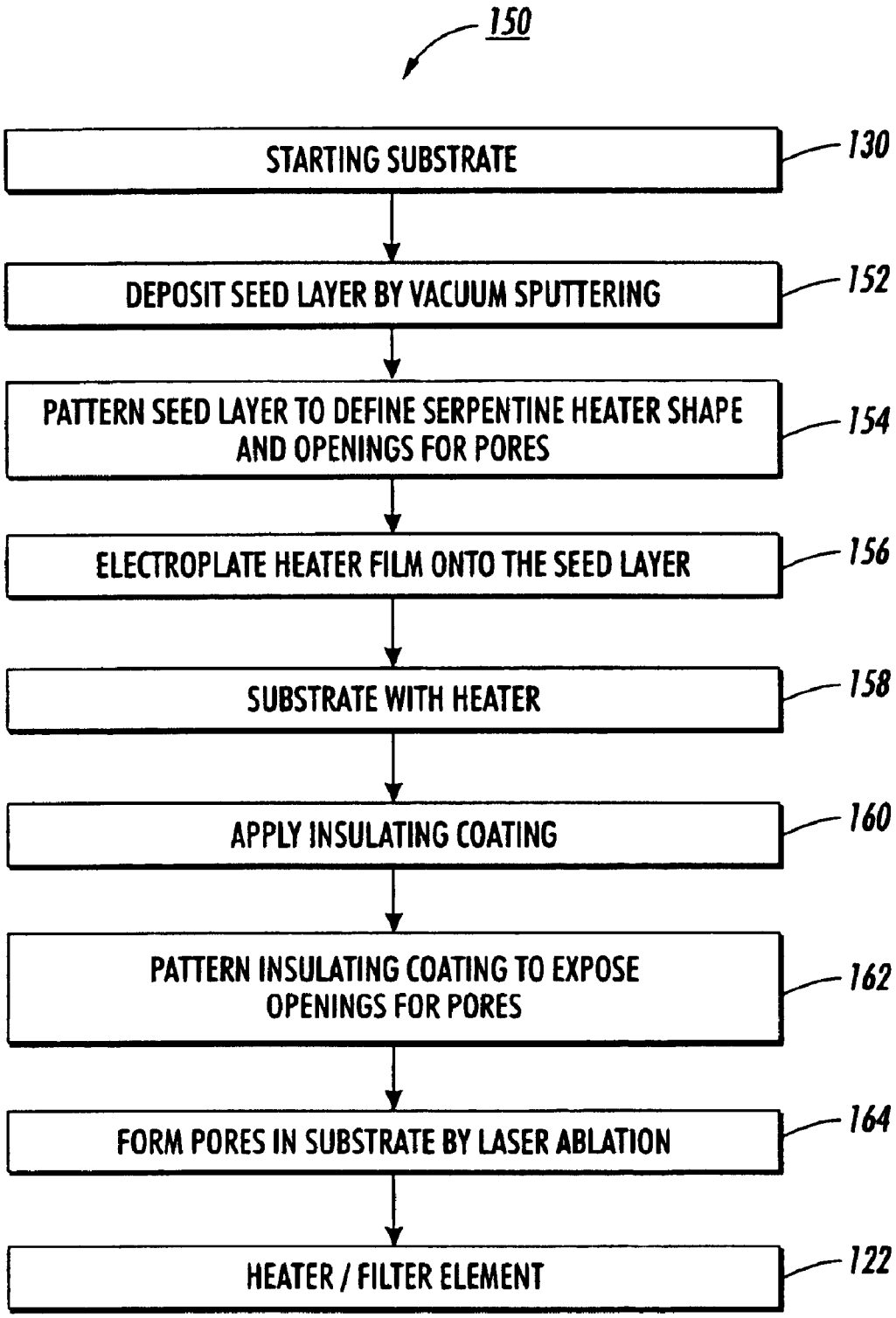
FIG. 8 flowcharts a method for fabricating the second embodiment of the combined filter/heater shown in FIGS. 6 and 7.

With continuing reference to FIGS. 6 and 7 and with further reference to FIG. 8, a suitable method 150 for fabricating the combined heater/filter ink processing element 122 is described. Beginning with the starting substrate 130, the seed layer 132*a* is deposited in a step 152 by a deposition techniques such as vacuum sputtering, thermal evaporation, electron beam evaporation, or the like. The seed layer 132*a* is lithographically patterned in a step 154 to define the serpentine or other shape of the heater film 132. The lithographic patterning step 154 also defines the openings 142*a* of the pores 142. Various photolithography techniques known to the art, for example, are suitable for performing the patterning 154. The electrically active material 132*b* is then applied by electroplating in a step 156 to produce a substrate/heater element 158. The electroplating 156 follows the seed layer 132*a*, and so the resistive layer 132*b* also includes the openings 142*a* therein. The insulating coating 144 is then applied in a step 160. The coating 144 can be applied by heat bonding, or can be applied as a deposited film, varnish coating, or the like. The insulating film 144 is patterned in a step 162 to expose at least the pore openings 142*c*. The pores openings 142*b* are formed inside the openings 142*a*, 142*c* in a step 164, preferably by a laser ablation technique, to complete fabrication of the ink processing heater/filter element 22.

It will be appreciated from FIGS. 6 and 7 that the heater metal openings 142*a* and the insulating film openings 142*c* are preferably larger than the laser ablated substrate openings 142*b* so that the effect of the laser ablation taper angle is minimized. However, it is also contemplated to omit the patterning step 162 as well as optionally the photolithographic defining of the metal openings 142*a*, and instead form all three opening components 142*a*, 142*b*, 142*c* of the pores 142 by the laser ablation step 164.

The ink processing element 122 is operated in the same manner as the ink processing element 22, i.e. it can be operated in open-loop fashion or in a feedback loop incorporating a temperature sensor (not shown). The ink processing element 122 is also suitable for thermal regeneration of the filter pores 142.

The embodiments 22, 122 of the ink processing element provides a number of advantages over past separate foil heaters and filters. The integration of filtering and heating into a single element reduces the number of parts in an ink jet cartridge or printhead while performing the same functions as a separate heater and filter, e.g. heating the ink and filtering particulate contaminants therefrom. The integration also provides additional benefits. By integrating the heating and filtering into a single component, improved heating of the filtering pores 42, 142 is achieved which reduces the potential for pore blockage by viscous ink. This advantage is especially significant when using ink which is in a solid phase at room temperature. Another advantage of the present invention is improved removal of dissolved air from the ink using an integrated combination of heating and porous filtering. The warm ink more readily releases air bubbles when passing through the pores 42, 142 and so is more effectively removed prior to entering the ink jet die. Removal of dissolved air is particularly valuable for die designs which operate at elevated temperature. A further advantage of integrating the heating and filtering into a single component is improved energy efficiency which substantially reduces undesirable heating of nearby system components.

Although the ink processing elements 22,122 include laser ablated pores 42, 142, the filter pores can also be formed in other ways. It is also contemplated to employ an intrinsically porous substrate, such as a fused silica, aerogel, or fused alumina substrate which provides intrinsic particulate filtering. In this arrangement the heater is formed on the porous substrate, e.g. according to the steps 52, 54, 56 of the method 50, the insulating coating is applied, e.g. according to the step 60, but the pore forming steps 62, 64 are suitably omitted in favor of the intrinsic filtering of the porous substrate. A disadvantage of using a porous substrate in the ink processing element is that it restricts the range of available substrates, and the filtering properties are less controllable and are limited to the filtering properties of the available porous substrates.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. An jet printhead comprising:

an ink jet die;

an ink reservoir, an ink path being defined between the ink reservoir and the ink jet die; and an ink processing element comprising:

a substantially planar insulating substrate arranged in the ink path and having one or more porous areas defined by pores sized to filter ink moving through the ink path; and a heater film deposited onto the insulating substrate that heats the porous areas of the insulating substrate responsive to an electrical input.

2. The ink jet printhead as set forth in claim 1, wherein the ink processing element further includes:

an insulating lay disposed over at least the heater and having openings corresponding to the porous areas of the insulating substrate.

3. The ink jet printhead as set forth in claim 1, wherein the heater film includes a conductive material deposited in a selected heat-distributing serpentine pattern on the insulating substrate.

4. The ink jet printhead as set forth in claim 1, wherein the conductive material is deposited partially or completely on the porous areas, the conductive material including openings corresponding to pores of the underlying porous areas.

5. The ink jet printhead as set forth in claim 1, wherein the substrate is formed of a porous material which defines the porous areas.

6. The ink jet printhead as set forth in claim 1, wherein the pores of the one or more porous areas include laser ablated pores.

7. The ink jet printhead as set forth in claim 6, wherein the laser ablated pores have a cross-section that promotes filtering of selected particles.

8. The ink jet printhead as set forth in claim 1, wherein the ink processing element further includes:

an insulating film deposited over the insulating substrate and the heater film and patterned to define openings communicating with the pores.

9. The ink jet printhead as set forth in claim 1, wherein the heater film includes:

a first metal layer deposited on the substrate and lithographically patterned; and a second metal layer electroplated onto the first metal layer.

10. The ink jet printhead as set forth in claim 9, wherein the first metal layer includes lithographically patterned openings corresponding with the substrate pores.

11. The ink jet printhead as set forth in claim 1, wherein the pores cooperate with heating produced by the heater film to release air bubbles from the filtered ink.

12. The ink jet printhead as set forth in claim 1, further including:

a printed wiring board providing the electrical input to the heater film, the printed wiring board providing an electrical input that effects one of open loop control and closed loop control of the heating of the porous areas.

13. The ink jet printhead as set forth in claim 1, wherein the ink jet die includes:

non-thermal ink ejectors.

* * * * *